US006874987B2

(12) United States Patent
Slinger et al.

(10) Patent No.: US 6,874,987 B2
(45) Date of Patent: Apr. 5, 2005

(54) COOLED TURBINE BLADE

(75) Inventors: John Slinger, Derby (GB); David W Barrett, Derby (GB); Christopher M Robson, Baden (CH)

(73) Assignee: Rolls-Royce plc, London (GB)

( * ) Notice: Subject to any disclaimer, the term of this patent is extended or adjusted under 35 U.S.C. 154(b) by 49 days.

(21) Appl. No.: 10/354,038

(22) Filed: Jan. 30, 2003

(65) Prior Publication Data

US 2003/0147750 A1 Aug. 7, 2003

(30) Foreign Application Priority Data

Feb. 5, 2002 (GB) ..... 0202619

(51) Int. Cl.[7] ..... F01D 5/18
(52) U.S. Cl. ..... 415/115; 415/116; 416/97 R
(58) Field of Search ..... 415/115, 116; 416/97 R

(56) References Cited

U.S. PATENT DOCUMENTS 3,527,543 A 9/1970 Howald
4,257,737 A 3/1981 Andress
5,117,626 A * 6/1992 North et al. ..... 416/96 R
5,348,446 A * 9/1994 Lee et al. ..... 416/241 R
5,370,499 A * 12/1994 Lee ..... 416/97 R
5,624,231 A 4/1997 Ohtomo
5,741,117 A * 4/1998 Clevenger et al. ..... 415/115
5,816,777 A 10/1998 Hall
5,857,837 A * 1/1999 Zelesky et al. ..... 416/97 R

FOREIGN PATENT DOCUMENTS

GB 1188401 P 4/1970

* cited by examiner

*Primary Examiner*—F. Daniel Lopez
*Assistant Examiner*—Igor Kershteyn
(74) *Attorney, Agent, or Firm*—W. Warren Taltavull; Manelli Denison & Selter PLLC

(57) ABSTRACT

A gas turbine engine turbine blade (20) has cooling air holes (38) arranged in groups, the holes (38) in one group and which span that part of the leading edge (34) that spans the hottest part of the blade (20), are more closely spaced than the remainder of the holes (38), thereby ensuring the provision of the most cooling air, where it is most needed.

3 Claims, 1 Drawing Sheet

COOLED TURBINE BLADE

FIELD OF THE INVENTION

The present invention relates to turbine blades of the kind used in gas turbine engines, wherein the operating temperatures are such as to require that the turbine blades be provided with a flow of cooling air around their leading edges, in order to maintain their structural integrity.

BACKGROUND OF THE INVENTION

It is known to form a turbine blade with interior compartments, to which relatively cool air from a compressor of an associated gas turbine is fed, and to provide holes in the blade leading edge portion, which holes connect one of those compartments in cooling air flow series with the blade leading edge surface.

It is also known to arrange the holes described hereinbefore in one or more rows, the or each hole being lengthwise of the blade, ie substantially normal to the axis of the associated engine, when the blade is in situ therein, the holes being equally spaced. Further it is known to form the holes so that when the blade is in situ in the engine, the holes axes and engine axis define respective acute angles, such that the air flow through the holes has a directional component radially outwardly of the engine axis.

The known art fails to properly address the cooling needs of cooled turbine blades, having regard to the temperature gradients along their leading edges, and further as a consequence, remove more air than is strictly necessary from the engine system, thus reducing overall engine efficiency.

SUMMARY OF THE INVENTION

The present invention seeks to provide an improved air cooled turbine blade.

According to the present invention an air cooled gas turbine engine turbine blade is provided with an internal compartment for the receipt of cooling air, and cooling air exit holes which connect said compartment in flow series with the leading edge surface of said blade, said exit holes being arranged in one or more rows lengthwise of the blade, and those holes spanning that portion of the blade leading edge that experiences the most heat being more closely spaced than the remainder thereof.

BRIEF DESCRIPTION OF THE DRAWINGS

The invention will now be described by way of example and with reference to the accompany drawings in which.

DETAILED DESCRIPTION OF THE INVENTION

Figure 1:
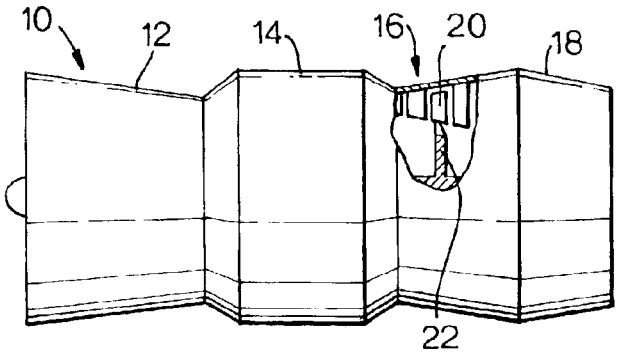
FIG. 1 is a diagrammatic view of a gas turbine engine including turbine blades in accordance with the present invention.

Referring to FIG. 1 a gas turbine engine 10 has a compressor 12, combustion equipment 14, a turbine section 16, and an exhaust pipe 18. Turbine section 16 includes a stage of turbine blades 20 mounted on a disk 22, for rotation in known manner, on receipt thereby of a flow of hot combustion gases from the combustion equipment 14.

Figure 4:
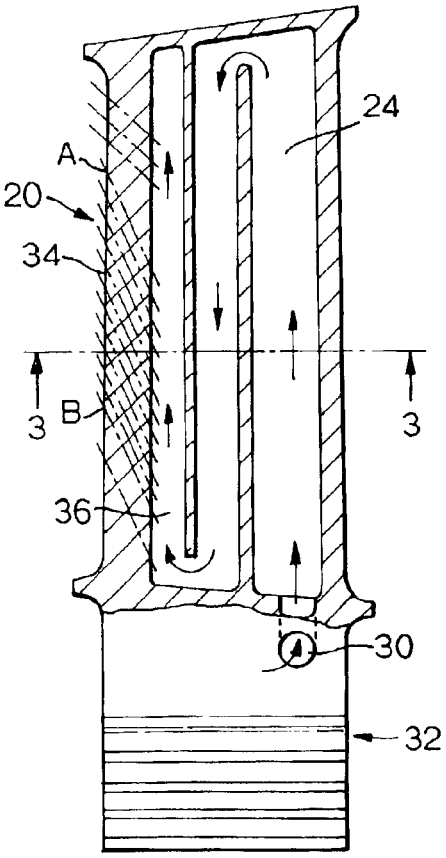
FIG. 4 is a development view on line 4—4 of FIG. 3.

Referring briefly to FIG. 4 each turbine blade 20 contains a compartment 24 which in the present example includes a pair of wall structures 26 and 28, which provide a serpentine flow path for a flow of cooling air from compressor 12. The air enters the compartment 24 via a hole 30 in the root portion 32 of blade 20, in known manner.

Figure 2:
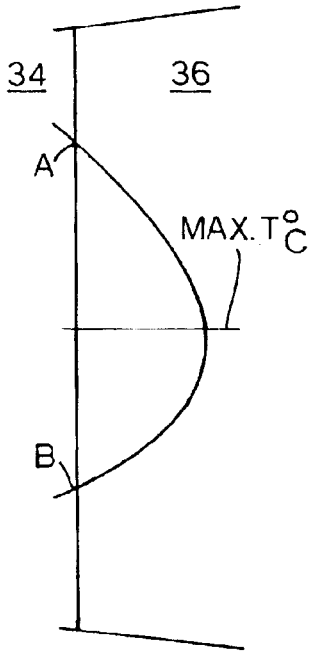
FIG. 2 is a graphic sketch of a typical temperature gradient over the leading edge of a turbine blade in situ in an operating gas turbine engine.

Referring now to FIG. 2 the temperature gradient along the leading edge 34 of a turbine blade is generally of the form depicted by the parabolic line 36 and clearly shows that the maximum temperature is experienced at about half way along the leading edge 34. Thereafter, the temperature reduces on both sides of the half length of the leading edge 34, to respective intersection points A and B. The leading edge portion of the blade which should be regarded as typically blade 20 that needs most cooling air, is thus clearly defined as being between points A and B.

Figure 3:
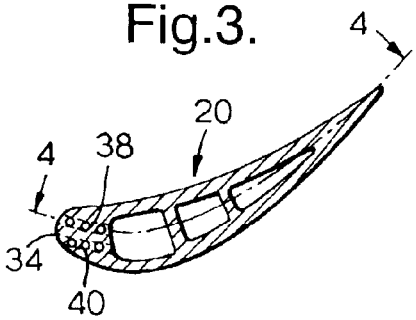
FIG. 3 is a view on line 3—3 of FIG. 4.

Referring to FIG. 3 the last portion 36 of compartment 24 to receive the cooling air flow, in the present example, is connected to the gas flow duct of turbine section 16 (FIG. 1) via two rows of holes 38 and 40, the rows being positioned side by side along the leading edge 34 of the blade 20, ie into and out of the plane of the drawing.

Referring to FIG. 4 in this view in which only the centrelines of holes 38 are shown for reasons of clarity, a large proportion of holes 38 are closely spaced over that portion of blade 20 that corresponds to portion A-B in FIG. 2, whereas only three more widely spaced holes 38 are provided near the upper end of blade 20, and only one hole 38 is provided in wide spaced relationship with the closely spaced holes at the lower end of blade 20. By this means, cooling air flow holes 38 (and 40) in a manner which ensures that the whole length of the leading edge of blade 20 receives the quantity of cooling air appropriate to the temperature it experiences.

The closely spaced holes 38 are aligned with respect to the engine axis, such that their axes define a large, acute angle therewith, and their cooling air outlet ends are radially further outwardly of the engine axis than their inlet ends. Their angular attitude results in them having to pass through greater thickness of blade metal than if they were aligned with the gas flow over blade 20. A benefit is derived from the arrangement in that the hot metal heats the air flowing through the holes 38, and generates a convection flow, ie it speeds up the air flow.

The three widely spaced holes 38 also have an angular attitude with respect to the axis of engine 10, which attitude however, is of smaller magnitude. The benefit derived is that the air flow has shorter, and therefore a quicker passage to reach the leading edge 34 and consequently is not so exposed to the convection affects of the hot metal. Therefore on reaching the leading edge 34, the air flow is cooler and though less in quantity, is sufficient to achieve the desired cooling of the outer end portion of the leading edge 34 of blade 2.

The arrangement of holes 38 in groups, some closely spaced and others more widely spaced, along the leading edge 34 of a turbine blade 20, as described hereinbefore has been shown on a test rig to achieve a reduction of 100° C. in the maximum temperature.

Whilst the embodiment of the present invention described hereinbefore is the preferred embodiment, the expert in the field having read this specification will appreciate that the grouping of the cooling air holes 38 in a manner appropriate to the temperature gradient on blade 20 provides the main contribution to the improvement, some improvement over the prior art referred to in this specification can be achieved by varying the angular relationship of the holes 38 relative to the engine axis, in ways that differ from those described herein with respect to the accompanying drawings. Even to the extent of aligning the groups of holes 38 with the axis of engine 10. Such an arrangement would reduce the difference in convective affect between the groups of holes 38 but this could be offset by the provision of more holes 38 near the end extremities of blade 20.

We claim:

1. An air cooled gas turbine engine turbine blade provided with an internal compartment for the receipt of cooling air, and cooling air exit holes which connect said compartment in flow series with the leading edge surface of said blade, said exit holes being arranged in at least one row lengthwise of the blade, and those holes spanning that portion of the blade leading edge that experiences the most heat, being more closely spaced than the remainder thereof wherein the axes of said cooling air holes are angled such that their cooling air outlet ends has a directional component radially outwardly of the axis of a said gas turbine engine, when associated therewith and wherein said radially outwardly directional component of said cooling air outlet ends of said more closely spaced holes differs from the radially outward component of the remainder thereof.

2. An air cooled gas turbine engine turbine blade as claimed in claim 1 wherein the axes of said more closely spaced holes are in parallel with each other.

3. An air cooled gas turbine engine turbine blade as claimed in claim 1 wherein said radially outwardly directional component of said cooling air outlet ends of said more closely spaced holes is greater than said radially outwardly directional component of the remainder thereof.

* * * * *